US009530395B2

(12) United States Patent
Friesen

(10) Patent No.: US 9,530,395 B2
(45) Date of Patent: Dec. 27, 2016

(54) MODULAR MUSIC SYNTHESIZER

(71) Applicant: Michael Friesen, Media, PA (US)

(72) Inventor: Michael Friesen, Media, PA (US)

( * ) Notice: Subject to any disclaimer, the term of this patent is extended or adjusted under 35 U.S.C. 154(b) by 104 days.

(21) Appl. No.: 14/483,100

(22) Filed: Sep. 10, 2014

(65) Prior Publication Data

US 2015/0068391 A1 Mar. 12, 2015

Related U.S. Application Data

(60) Provisional application No. 61/875,900, filed on Sep. 10, 2013.

(51) Int. Cl.

| | |
|---|---|
| ***G10H 1/02*** | (2006.01) |
| ***G10H 5/00*** | (2006.01) |
| ***G10H 1/06*** | (2006.01) |
| ***G10H 1/32*** | (2006.01) |

(52) U.S. Cl.

CPC ..... *G10H 1/06* (2013.01); *G10H 1/32* (2013.01); *G10H 2220/116* (2013.01); *G10H 2250/471* (2013.01)

(58) Field of Classification Search

CPC ..... G10H 1/06; G10H 1/32; G10H 2220/116; G10H 2250/471

USPC ..... 84/701

See application file for complete search history.

(56) References Cited

U.S. PATENT DOCUMENTS 4,974,187 A 11/1990 Lawton
4,998,960 A 3/1991 Rose et al.
5,741,990 A * 4/1998 Davies ..... G09B 15/004 84/423 R
6,271,453 B1 * 8/2001 Hacker ..... G09B 15/003 434/171
6,376,761 B1 * 4/2002 LaMarra ..... G10H 1/02 381/118
7,786,371 B1 * 8/2010 Moates ..... G10H 1/0066 84/464 R
7,956,271 B1 * 6/2011 Jonas ..... G09B 15/00 84/476

(Continued)

OTHER PUBLICATIONS

"K2000 Musician's Guide," Young Chang Co., 1999.

(Continued)

*Primary Examiner* — Jeffrey Donels
(74) *Attorney, Agent, or Firm* — Paul & Paul

(57) ABSTRACT

A modular music synthesizer is implemented in a hybrid design incorporating both hardware implementation and software implementation. A plurality of hexagonal-shaped modules are assembled and connected by the user-artist to configure a visual presentation of synthesizer signal generation and signal processing functions. The synthesizer visually replicates hardware functionality by incorporating user controls on many of the modules that are connected to enclosed (embedded) circuit boards. These circuit boards communicate with a system CPU (computer processing unit) that operates softsynth software resident within the CPU to drive audio output. The configuration of the softsynth is determined by the physical arrangement of hardware hexagonal modules that represent the functionality of software modules. The hardware modules provide user interface elements corresponding to parameters of their softsynth counterparts.

20 Claims, 12 Drawing Sheets

(56) References Cited

U.S. PATENT DOCUMENTS

| | | | | |
|---|---|---|---|---|
| 8,420,923 | B1 * | 4/2013 | Choi | G10H 1/32 84/476 |
| 2003/0121401 | A1 * | 7/2003 | Ito | G10H 1/0083 84/625 |
| 2005/0241467 | A1 * | 11/2005 | Lo | G10H 1/344 84/744 |
| 2007/0000374 | A1 * | 1/2007 | Clark | G10H 1/0008 84/724 |
| 2007/0155313 | A1 * | 7/2007 | Goldberg | G10H 1/0025 455/3.06 |
| 2009/0188378 | A1 * | 7/2009 | Folkesson | G10H 1/34 84/615 |
| 2009/0301289 | A1 * | 12/2009 | Gynes | G10H 1/0066 84/645 |
| 2010/0064883 | A1 * | 3/2010 | Gynes | G10H 1/32 84/645 |
| 2012/0090447 | A1 * | 4/2012 | Hinokio | G06F 1/1626 84/601 |
| 2013/0138233 | A1 * | 5/2013 | Sandler | G06F 17/00 700/94 |
| 2013/0302763 | A1 * | 11/2013 | Edwards | G09B 1/36 434/159 |
| 2014/0260908 | A1 * | 9/2014 | Yoshikawa | G10H 1/00 84/609 |
| 2015/0068387 | A1 * | 3/2015 | Shi | G09B 15/023 84/471 R |
| 2015/0095883 | A1 * | 4/2015 | Shi | G06F 3/048 717/109 |
| 2015/0262565 | A1 * | 9/2015 | Lifshitz | G10H 1/344 84/433 |

OTHER PUBLICATIONS

Dan Solaris, "Synthesizer Basics," donsolaris.com, Mar. 18, 2014. http://www.donsolaris.com/?p=493.

"Buying Your First Analog Synthesizer: the 2013 Guide," The Synthesizer Sympathizer, May 13, 2013. http://www.thesynthesizersympathizer.blogspot.com/2013/05/buying-your-first-synthesizer-2013- . . . .

Sweetwater, "Vast," sweetwater.com, Mar. 8, 2000. http://www.sweetwater.com/insync/vast/.

Sweetwater, "Kurzweil's V.A.S.T. Technology and Its Gain Structure," sweetwater.com, Oct. 6, 2003. http://www.sweetwater.com/insync/kurzweil-v-st-technology-gain-structure/.

Schiettecatte, Bert. "AudioCubes: a Distributed Cube Tangible Interface based on Interaction Range for Sound Design", pp. 3-10, Feb. 18, 2008, Proceedings of the Second International Conference on Tangible and Embedded Interaction, Bonn, Germany. http://citeseerx.ist.psu.edu/viewdoc/summary?doi=10.1.1.116.9378.

Puckette, Miller. "Pure Data: another integrated computer music environment." May 7, 1997, pp. 37-41, Proceedings, Second Intercollege Computer Music Concerts, Tachikawa, Japan http://msp.ucsd.edu/Publications/cmf96.ps.

Puckette, Miller. "The Patcher", Proceedings of the Interational Computer Music Conference, Nov. 8, 1988, International Computer Music Association, Kologne, Germany http://msp.ucsd.edu/Publications/icmc88.pdf.

Walker, Martin. "Native Instruments Generator 1.5 Software Synth Review". Sound on Sound Magazine. Sep. 1998. Cambridge, UK. http://www.soundonsound.com/sos/sep98/articles/generator.html.

Walden, John. "Audulus review—modular synthesis app from Subatomic Software" MusicAppBlog, Dec. 12, 2013 http://www.musicappblog.com/audulus-review/.

Bianchini, Riccardo & Cipriani, Alessandro. Virtual Sound: Sound Synthesis and Signal Processing—Theory and Practice with Csound translated from "Il Suono Virtuale", 1998, Con Tempo s.a.s, Rome, Italy http://www.virtual-sound.com/demo/VirtualSound.pdf.

Scaletti, C.A. & Johnson, R.E. "An Interactive Environment for Object-oriented Music Composition and Sound Synthesis", Proceedings of the 1988 Conference on Object-Oriented Programming Languages and Systems. Association for Computing Machinery, 1988, New York.

Propellerhead, "Propellerhead adds signature patches for Thor polysonic synth". Propellerhead website. Aug. 20, 2007. Stockholm, Sweden. https://www.propellerheads.se/press/59-propellerhead-adds-signature-patches-for-thor-polysonic-synth.

Arturia, "Press Release: Arturia announces the release of Modular V". Jan. 16, 2003. Grenoble, France. http://arturia.com/company/press/press-releases/arturiaannouncesthereleaseofmodularv.

Arturia, "Press Release: Arturia announces Origin Keyboard shipping in March". Jan. 14, 2010. Grenoble, France. http://arturia.com/company/press/press-releases/arturiaannouncesoriginkeyboardshippinginmarch.

Jordà, Sergi et al., "The Reactable". International Computer Music Association, Sep. 2005. Barcelona, Spain. http://modin.yuri.at/publications/reactable_icmc2005.pdf.

Theo Bloderer, "Musikmesse 2009 Vintage Synthesizers". Amazona.de. Apr. 5, 2009. Karlsfeld, Germany. https://www.amazona.de/report-musikmesse-2009-vintage-synths/5/.

Littlebits, "LittleBits Announces partnership with Korg, Launch of New littleBits synth kit", Nov. 8, 2013. New York. http://media.littlebits.cc/wp-content/uploads/2012/11/Synth-Kit-Release.pdf.

Travis Feldman, "Molecule Synth 1.1 owner's manual". Jun. 2012. Portland, Oregon. http://www.moleculesynth.com/manual.pdf.

Jim Aikin, "U-HE ACE Monster Analog Sound from a Soft Synth". Keyboard Magazine. May 1, 2010. New Bay Media, New York. http://www.keyboardmag.com/gear/1183/u-he-ace-monster-analog-sound-from-a-soft-synth/27768.

Nagle, Paul. "Clavia Nord Modular Virtual Analogue Modular Synthesizer". Sound on Sound Magazine. Apr. 1998. Cambridge, UK. http://www.soundonsound.com/sos/apr98/articles/nord_modular.html.

Neils Gorisse, "CPS Intro". CPS website. 2000. Utrecht, Netherlands. http://cps.bonneville.nl/intro.php.

* cited by examiner

MODULAR MUSIC SYNTHESIZER

RELATED APPLICATIONS

This application claims priority to U.S. Provisional Patent Application No. 61/875,900, filed Sep. 10, 2013, for "Modular Experimental Synthesizer", the invention of Michael Friesen. That Provisional Patent Application is incorporated in its entirety herein as if recited herein in full.

BACKGROUND OF THE INVENTION

The present invention is directed to audio synthesizers, specifically music synthesizers, and more specifically modular music synthesizers. A sound synthesizer (often abbreviated as "synth") is an electronic musical instrument that generates electric signals (waveforms) which can be converted to sound by loudspeakers or headphone speakers. Synthesizers can imitate musical instruments and/or generate new sounds.

Synthesizer circuitry generally includes an array of electronic components, such as amplifiers, oscillators, AC or DC power sources, filters, frequency generators, envelope generators and controllers, mixers, multiplexers, phase shifters, phase distortion circuits, frequency choppers, and signal dampers.

Synthesizer signal processing can include subtractive and/or additive signal processing, frequency modulation, wave-table signal generation, sub-harmonic signal mixing, signal phase distortion, and low frequency, mid frequency, and high frequency separate signal manipulation. Subtractive synthesis filters waveforms in selected frequency ranges. Additive synthesis adds waveforms to the signal in selected frequency ranges. Frequency modulated (FM) synthesis changes the frequency and/or amplitude of a signal carrier frequency.

Early synthesizers were only analog circuits which used analog signal detection and manipulation, including implementing analog computer algorithms to generate and output signal envelopes. With the growth in the digital circuit industry, digital synthesizers were introduced which operated according to digital signal processing (DSP) algorithms. The synthesizer programming and control input devices remained relatively the same, i.e., keyboards, knobs, and switches, though the numbers of knobs and linear faders were often reduced in number in order to reduce costs. The advantage in providing digital circuitry in synthesizers, as opposed to analog circuitry, is the same as for other products, i.e., reduction in power consumption, reduction in size, and eventually, reduction in costs.

Modular synthesizers preceded keyboard-based instruments, and continued to be developed, albeit as more expensive, complex, and often esoteric instruments than keyboard-based synthesizers. A modular synthesizer is an electronic unit comprised of "modules" which are connected together by way of patch cords. Voltages from modules may function as audio signals, control signals, or indicators of logic conditions. Each module is built to perform a specific function or several functions and nothing else. A module may have its own active controls, or it may be a slave module with predetermined operational functions. Examples of modules for a modular synthesizer are units dedicated to act as one of the following: voltage controlled oscillators (VCO), white, pink and low frequency noise generators, low frequency, mid-frequency, and high frequency oscillators (LFO, MFO, HFO), complex power sources providing ADSR contours or envelopes (attack, decay, sustain, release), voltage controlled filters and amplifiers (VCF, VCA), mixers, modulators, and sequencers. These modules are selected/built and interconnected to build an audio synthesizer system with desired capabilities.

With progress in personal computers (PC) and software development (software programming techniques), software synthesizers (softsynth) were introduced. Softsynth is a computer program, implemented in downloaded software, or in a pre-programmed plug-in device, to enable a PC to provide digital audio generation under the control of the PC keyboard and mouse. Advances in PC-CPU design and processing speeds allow softsynth to create a desired audio output as with analog and digital synthesizers. Softsynth software is written for specific operating systems, such as Win98, Win XP, Win 7, Apple® MacOSX.

Early audio synthesizers were built as simple circuits with a narrow scope of functions and limited abilities. Today, commercially available audio synthesizers are typically either very simple or very complicated. There are very few products available having intermediate technology. As a result, a novice who starts on a very simple unit is often intimidated when he/she begins to step up to more complicated units.

Modern synthesizers defy exploration by an untrained explorer. Simply sorting out a signal chain is not immediately intuitive or gratifying. Debugging a sound is difficult for most new users. A neophyte cannot approach any modern hardware (or most software) synthesizers and come to a rapid understanding of how to create a sound. Electronic musicians understand that the most basic signal chain involves a keyboard triggering an oscillator which produces an audio signal that is fed to an amplifier. But producing pleasing sounds takes more than this. By the time one possesses the skills to design a synthesizer, the principles of sound chains are so deeply entrenched that they are tacitly considered a prerequisite to approach the instrument at all, and anything simple enough to draw in a novice will be unsatisfying to an experienced artist.

That situation is amplified when it comes to modular synthesizers. As beautiful as they are, these instruments are daunting even to those with some knowledge of synthesis, and they typically have prices that will discourage hobbyists and semi-professional explorers. While softsynth units are affordable the cognitive barrier persists and problems of ergonomics remain: the Cartesian paradigm of the mouse is inappropriate to manipulate rotary controls and softsynth control panels, commonly shrunk to fit into a computer screen, lack the immediacy, tactile characteristics, and real world quality of a physical instrument.

An objective of the present invention is to provide a synthesizer that almost anybody, from a novice to an experienced electronic musician, can approach in an intuitive and flexible manner.

Another object is to provide a synthesizer built from a plurality of hardware modular units, which synthesizer can be configured by the user, who can arrange the physical positions, and insert or remove modules.

A further object is to provide hardware modules that can be connected without external wiring.

An even further object is to provide a synthesizer which is expandable in functionality and complexity, being expanded by the user.

An additional object is to provide a synthesizer which can be implemented as a softsynth unit which appearing to operate as a hardware unit to the musician user.

SUMMARY OF THE INVENTION

These objects are realized in a modular music synthesizer having signal generation and processing by both hardware and software implementation. The synthesizer is assembled by the user-artist from a plurality of physical modules each containing software driven circuitry. These modules include user-artist operated controls connected to the circuitry the module depending upon the processing function emulated within a module. A system central processing unit (system CPU) is in communication with each module and generates audio output using resident softsynth software. In functioning according to the softsynth software, the CPU processes signals according to a software defined virtual modular synthesizer, the configuration of which is determined by the connections of the physical modules.

The physical modules are each hexagonal-shaped, and of one of two sizes, which facilitates the convenient physical interconnection of modules. The larger size may be 20 cm across diagonal corners, while the smaller size may be 12 cm across diagonal corners. The user assembles the components by plugging modules into each other or by unplugging modules from each other. The sequence and interconnection of modules is communicated to and monitored by the system CPU. Resident within each module is a relatively simple controller board, such as an ARDUINO Board, and associated memory. Plugging one module into another is a configuration event.

Non-configuration events are triggered by the manipulation of controllers on module surfaces. These non-configuration events, i.e., control key movement and controller manipulation, can be transmitted either as a standard MIDI (musical instrument digital interface) event by way of a device attached to a USB port on the AmpIO module or form the front panel of a module itself. This permits a conventional MIDI (musical instrument digital interface) keyboard to be connected to the CPU via a protocol interface. Virtual module parameters are set and stored using data contained in a configuration filed for that module.

RFID (radio frequency identification) is used to detect connection between modules, which connection is transmitted to the system CPU which evaluates a reported connection and either initiates a corresponding connection in the virtual modular synthesizer, or rejects the connection. Improper, or invalid, or incomplete connections are rejected and the CPU provides feedback to the user with indicator lights or a text message. The hexagonal module shapes provide overlapping rhomboids as a connection paradigm, where power transfer and inter-module connection is enabled. Modules connect to each other through groove-and-notch overlaps. Using an IO Amp module as a base, nominal electrical power is passed through each module. Modules detect each other by two-way RFID defection, but do not communicate with each other as there is no need. All controls from the module to the CPU and any feedback to the module are direct and wireless.

The core synthesizer provides for subtractive synthesizing with the following virtual modules: Amp-IO, oscillator, two low frequency oscillators (LFO), two envelope generators (EG), and a filter. Extended modules such as a multi-filter, a step sequencer, a realtime recorder, a key drum pad and an FX processor may be added. Advanced modules can also be introduced. They can add virtual sampling, a virtual multi-oscillator, a virtual multi-filter, virtual advanced envelope generation, a virtual additive oscillator, a virtual advanced keyboard input, and a virtual multiplexer.

The oscillator module provides the user the opportunity to select wave shape from among sine, square, pulse, sawtooth, and noise waveforms. Buttons are rubberized and internally illuminated. Sliders and faders are capacitive touch sliders. Default parameters are programmed into each module's circuit board, optionally over-ridden by a configuration file stored in system CPU memory. This facilitates getting results by new users while permitting an experienced user to engage advanced control mechanics.

The modules of the core synthesizer provide virtual functions for each module. The AmpIO (input-output amplifier) module contains the system CPU and input-output functions. It functions as a three-channel audio mixer. The oscillator module provides six waveforms across a six-octave range and supports PWM (pulse width modulated) and FM (frequency modulated) signal processing. The oscillator module can support three different modulators, can provide three outputs and fine tuning and pitch bending. The filter module can have six filter types and has controls for frequency and resonance. It has three inputs for audio signals or control signals to modulate filter frequency or resonance. The low frequency oscillator (LFO) module has six waveform selectors with ramp options and frequency control. It provides an input for FM or PWM by a control source. The envelope generator (EG) is a four-stage ADSR (attack, decay, sustain, release) envelope generator with polarity control. The EG either generates control signals and/or acts as a gate-contour generator for through signals.

The invention uses physical interfaces (interconnected hexagonal modules) to control the configuration of a virtual modular synthesizer implemented in software. The virtual modular softsynth is instantiated and configured on a general-purpose lower level computer (such as a RASBERRY PI or a BEAGLEBONE BLACK) located inside the AmpIO module. Common synthesizer modules are represented by dedicated controllers connected to each other to emulate a signal chain. While these modules are physically connected to each other, the actual configuration of the synthesis engine occurs inside the AmpIO module. When a module receives power through its connection to another module, it transmits its identity and connection status to the System CPU (SCPU) in the AmpIO module, which dynamically reconfigures a modular synthesizer in software. Software on the AmpIO module implemented by the CPU dynamically instantiates corresponding modules and connects them with a virtual signal chain. For example, an EG and an LFO may be physically configured to modulate an oscillator, the output of which is sent to a filter. The filter's frequency is modulated by another EG and the output of the filter is sent to the amplifier module.

Only the AmpIO module draws power directly from a main power cable. All other modules draw power through their connections, directly or indirectly to the AmpIO module. The connection between other modules is on a power level and on a logic level. The logical connection between modules other than the AmpIO module is only a two way RFID handshake. Once a power level connection is made, each module can poll an ultra-short-distance RFID sensor circuit at the connection point. If a valid connection is detected, the module will transmit an indication of such connection to the system CPU, the message containing the module's own identity as well as that of the detected (newly connected) module. Each module has RFID transmitters and receivers for enabling detection and confirmation protocol for inter-module connections. Redundant connections can be utilized for error checking. If only a single connection is reported, the system CPU will optionally alert the user to a potential hardware failure. If two conflicting connections are reported, CPU will signal a link failure to the user by setting the corresponding module connector lights to flash. In addition to the lights indicating a valid connection, the user may be able feel the connection by a snap or magnetic pull, insofar as the module-to-module connections feature complementary magnets. Except for the AmpIO, modules do not pass any control data to each other. The only information transmitted between modules (excepting the AmpIO) is the RFID-based connection signal. Pass-through data or logic circuitry is not required because all modules communicate wirelessly with the AmpIO directly.

Although all effective configurations of the synthesis circuitry actually occur in software, the paradigm of the invention is that the modules are representationally connected through their physical interfaces. To the user, the physical oscillator module appears as an oscillator although its actual implementation is in software in the CPU. Thus, when the user decouples a module, the software instantly disconnects it in the virtual machine. The system CPU will remember the last state of the module when connected to any other module, restoring the last state the next time the module is plugged into a module of the same type. This will allow the user to have pre-set module states. It will also allow the user to disconnect and reconnect a module without having to re-set all of that module's parameters.

The CPU can be running on a web server. If a video display monitor, and a keyboard and mouse are connected to the CPU in the AmpIO module, the user can control nearly all system functions, and possibly the entirety of the module configuration, by way of the web interface. The SD (secure digital) card which contains the CPU operating system and the softsynth configuration files may be removed from the CPU and accessed directly in order to affect changes and/or update the software.

BRIEF DESCRIPTION OF THE DRAWINGS

The features, advantages and operation of the present invention will become readily apparent and further understood from a reading of the following detailed description with the accompanying drawings, in which like numerals refer to like elements, and in which:

FIG. 18 shows a perspective side view of an AmpIO module showing input and output connection ports;

DETAILED DESCRIPTION OF THE INVENTION

Figure 1:
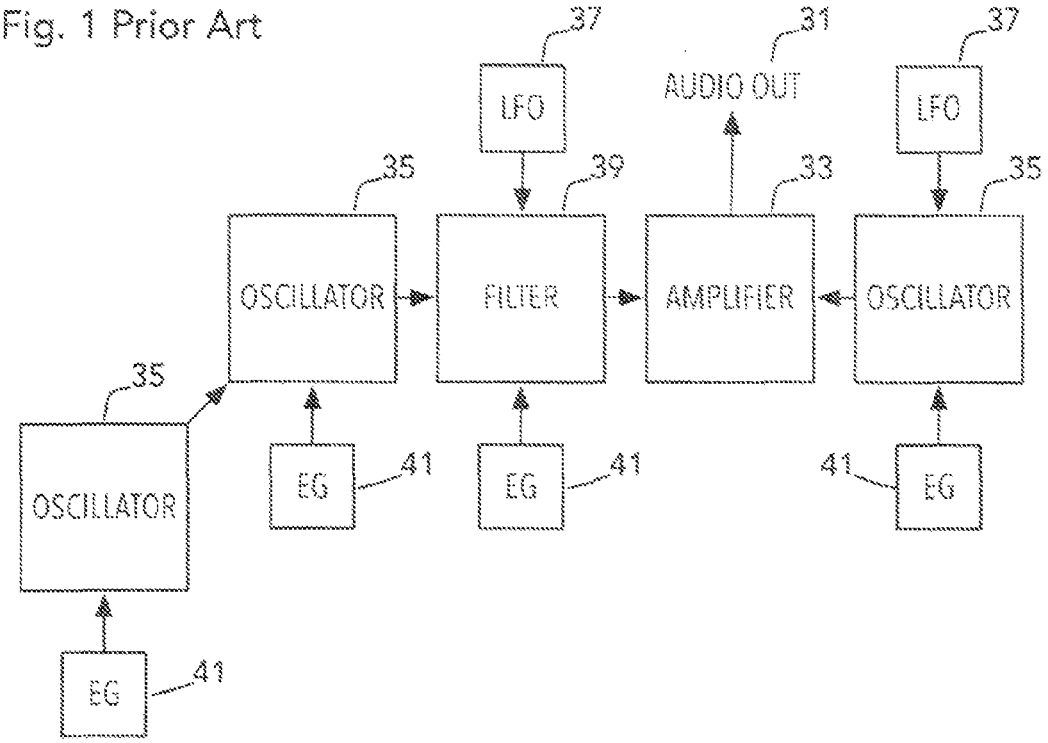
Fig. 1 Prior Art
FIG. 1 is a block diagram of a hardware implemented audio synthesizer in the prior art.

The present invention is a hardware/software product that emulates the functionality of a modular synthesizer using physical components that are easy to configure and manipulate. When these physical components, being hexagonal-shaped modules, are in close physical proximity to each other. Wireless sensors report a possible connection to a computer, which reconfigures a virtual synthesizer to mirror the physical arrangement. A user musician can physically "connect" a low-frequency oscillator to a filter, and a computer program will echo that physical arrangement in a software-based synthesizer.

The present modular music synthesizer is based on two complementary existing technologies: (1) soft-synths which can be dynamically configured in real-time; and (2) real-time controllers which communicate with a base station in an ad-hoc wireless network. The physical arrangement of shapes, as a function of location in space relative to each other and detected without wires, using radio sensors, causes a configuration of sound control elements to be generated by the softsynth software. This is separate and distinct from the user setting the control parameters of a synthesizer. The invention, with its hybrid, hardware-software configuration, allows the user to control the parameters of synthesis modules and the overall structure of a modular synthesizer through proximity of physical shapes that represent sound-shaping modules.

The modules are hexagonal shaped with overlapping rhomboids as a connection paradigm. Power transfer and inter-module connection detection is enabled as a result of this connection. RFID sensing is used to detect connections between modules, with this detection transmitted to a system CPU, which evaluates the reported connection and either instantiates a corresponding connection in a virtual modular synthesizer, or rejects the connection and provides feedback to the user by way of indicator lights and/or a text message on a screen. The connection points can have magnet-assisted or mechanical locks.

A subtractive synthesizer unit can be modularly assembled include an AmpIO module, an oscillator module, two low-frequency oscillator modules, two envelope generators modules, and a filter module. Other modules which may selectively be added include memory, step sequencer, realtime sequencer, key drum pad, and FX processor, sampling, multi-oscillator, multi-filter, advanced EG, advanced keyboard, and multiplexer modules. Modules are paired with and must be compatible with the capabilities of the system CPU in the base AmpIO. The AmpIO module contains internal electronics, including a compact computer (the system CPU) with a custom-modified operating system. The sound-creation code may be based on c-sound and/or Gen.

Optional advanced functionality is enabled by way of a web interface running on the AmpIO system CPU.

Modules are connected to each other through groove-and-notch assisted overlaps. Using the AmpIO module as a base, nominal electrical power is passed through each module. Provision can also be made for battery power. Modules detect each other by way of passive RFID, but they do not otherwise communicate with each other as there is no need to. All controls from the module to the system CPU and feedback indicators returned to the module from the system CPU are implemented as wireless transmissions, transmitted directly between the module and the AmpIO-based computer.

The present invention includes some of the functions of a prior art hardware, analog or digital, synthesizers. Such hardware implemented synthesizers can be constructed of various audio signal processing components into a system having desired audio generation capabilities and requiring varying degrees of control.

An example is the synthesizer 31 shown in FIG. 1, which includes an amplifier 33 as an output driver, and has an interconnection of a plurality of oscillator circuits 35, a plurality of low frequency oscillators (LFO) 37, at least one filter circuit 39, and a plurality of envelope generators 41. The numbers of each components and the interconnection and string connection of components determines the capability and operation of the synthesizer 31.

Figure 2:
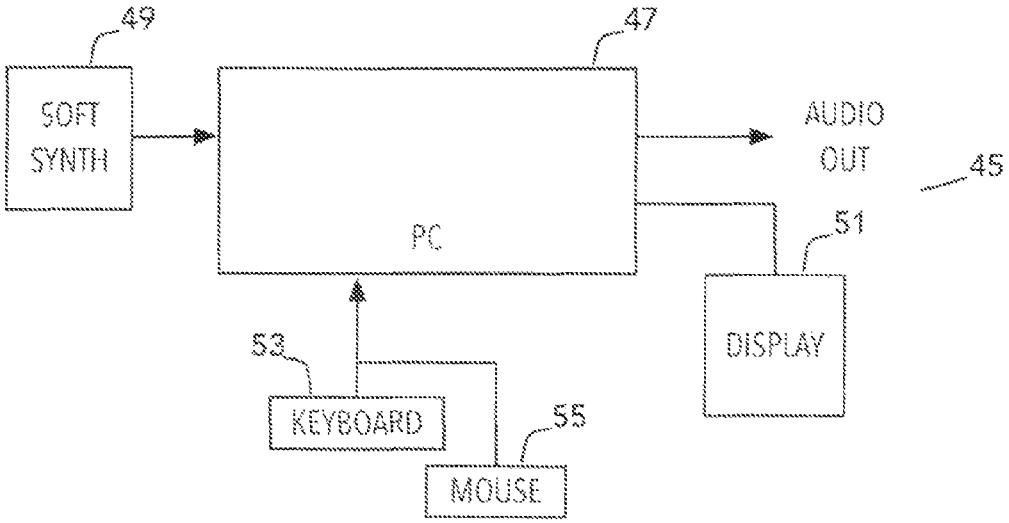
Fig. 2 Prior Art
FIG. 2 is a block diagram of a software (softsynth) implemented audio synthesizer in the prior art.

The present invention also includes some of the functions of a prior art, software synthesizer (softsynth). Such a softsynth synthesizers 45, FIG. 2, have been implemented with a personal computer (PC) 47 which provides the audio output. Connected to the PC 47 is an SD softsynth disk 49, a display 51, and a keyboard 53 and mouse 55. The user-musician controls the softsynth synthesizer via the keyboard 53 and mouse 55.

Figure 3:
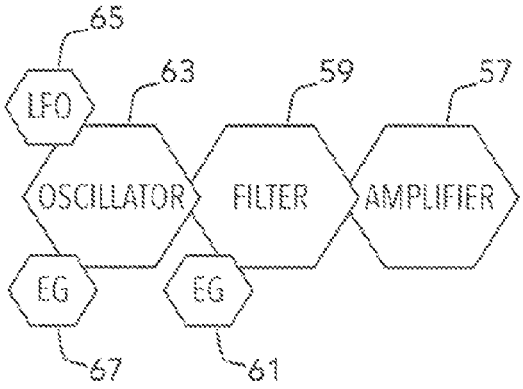
FIG. 3 is a block diagram of an interconnection of hexagon-shaped virtual modules in the hybrid implemented modular music synthesizer of the present invention.

A modular interconnection of modules for the present invention is shown in FIG. 3. Like other audio synthesizers, the hybrid, modular synthesizer of the present invention can have various configurations. The amplifier module 57 has a filter module 59 connected thereto, The filter 59 has an EG module 61 and an oscillator module 63 connected to it. The oscillator module 63 has an LOF module 65 and an EG module 67 connected to it.

Only the AmpIO (amplifier) module 57 draws power from a power supply. All other modules draw power through their connections using a physical connection which uses multiple electrically redundant links. A provision for battery power may be established in some modules. The modules connect to each other on two independent levels: power and logic.

The logical connection between modules other than the AmpIO 57 consists solely of a two-way RFID handshake. Once a power connection exists, each module will poll an ultra-short-distance RFID sensor circuit at the connection point. When a connection is detected, the module will transmit its understanding of the connection to the system CPU which is contained in the amplifier module 57. Each module has both an RFID transmitter and receiver enabling a detect and confirm protocol for inter-module connections. Redundant connections may be used for failures and error-checking purposes.

The AmpIO module 57 provides audio outputs. The other modules do not pass any sound control data. The only information transmitted between modules is the RFID-based connection signal. All modules communicate wirelessly with the AmpIO module 57, directly.

All effective configuration of the audio synthesis circuitry occurs in software. The paradigm of the present invention is that the modules are being connected through their physical interfaces. To the user, the physical oscillator module appears to respond as a physical. When the user decouples a module, the software instantly disconnects it in the virtual machine. There will not be any situations where an LFO could be plugged into an oscillator, configured, removed, and then plugged into a filter as a second LFO. The physical piece has a one-to-one mapping with the virtual module.

Contained within each hexagonal-shaped module is a dedicated circuit which acts as a detector-transmitter, i.e., a transceiver. Physical controls on the top face of each hexagonal module provide signals, i.e., instructions to the resident transceiver which are in turn transmitted to the system CPU resident in the AmpIO module 57.

Figure 4:
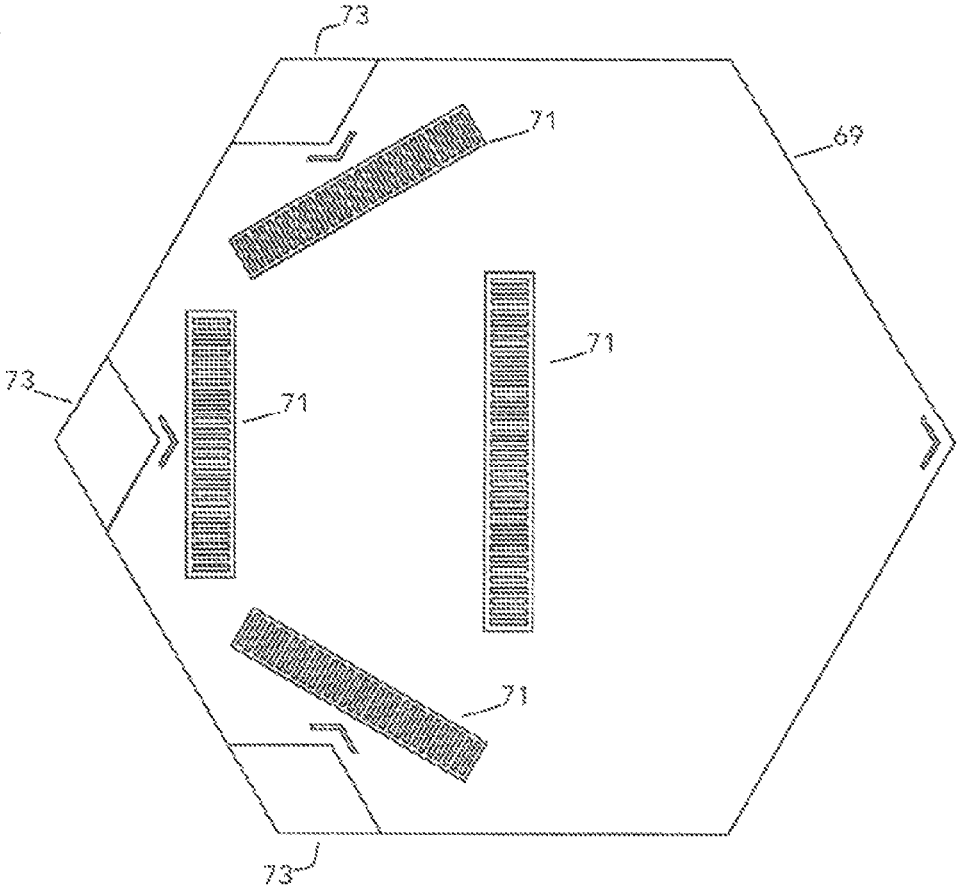
FIG. 4 is a top plan view of a hexagon shaped AmpIO module for the present invention.

The amplifier AmpIO module 69, FIG. 4, includes four slider controls 71 on its top face. Three of these slider controls 71, face a respective module connection location 73. A fourth slider 71 is centrally located. The AmpIO which houses the system CPU acts as a three-channel audio mixer.

Figure 5:
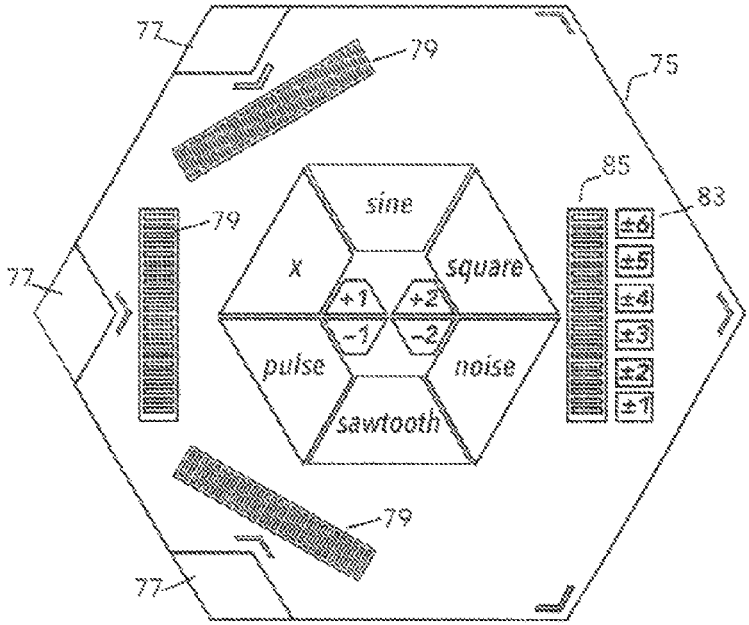
FIG. 5 is a top plan view of a hexagon shaped oscillator module for the present invention.

An oscillator module 75, FIG. 5, also has three module connection locations 77 with a respective slider control 79. A wave shape selector 81 is centrally located. A series of octave selector buttons 83 and an associated volume slider control 85 are positioned on the opposite side. The oscillator module 75 provides six waveforms across a six-octave range and supports PWM and FM and three modulators, three inputs and fine tuning. The oscillator module can also trigger sounds from waveform pads.

Figure 6:
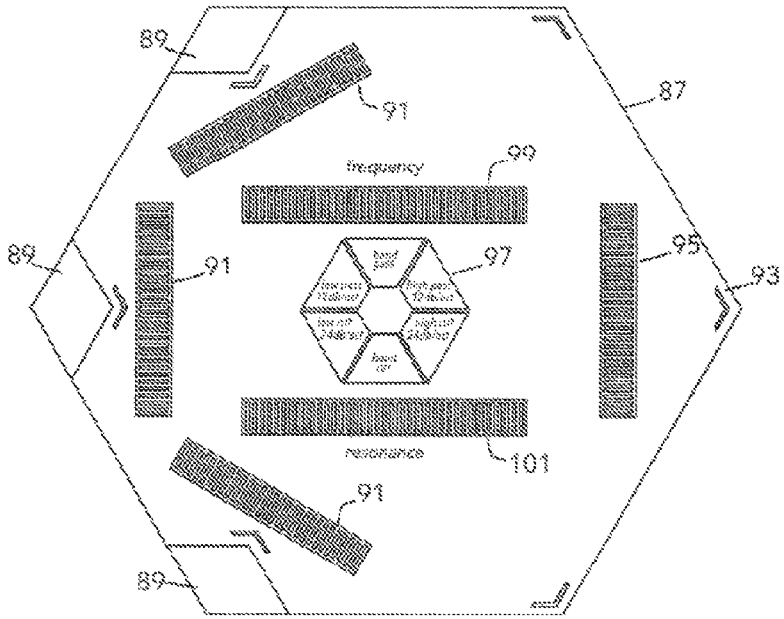
FIG. 6 is a top plan view of a hexagon shaped filter module for the present invention.

A filter module 87, FIG. 6, has three active receiving connection points 89 with a respective slider control 91, and one projecting connection point 93 with an associated slider control 95. Centrally located on the top of the filter module 87 is a filter selector 97, with an associated frequency slider control 99 and a resonance slider control 101. The filter module 87 facilitates six filter types and controls for frequency and resonance. It provides three inputs for audio or control signals to modulate frequency.

Figure 7:
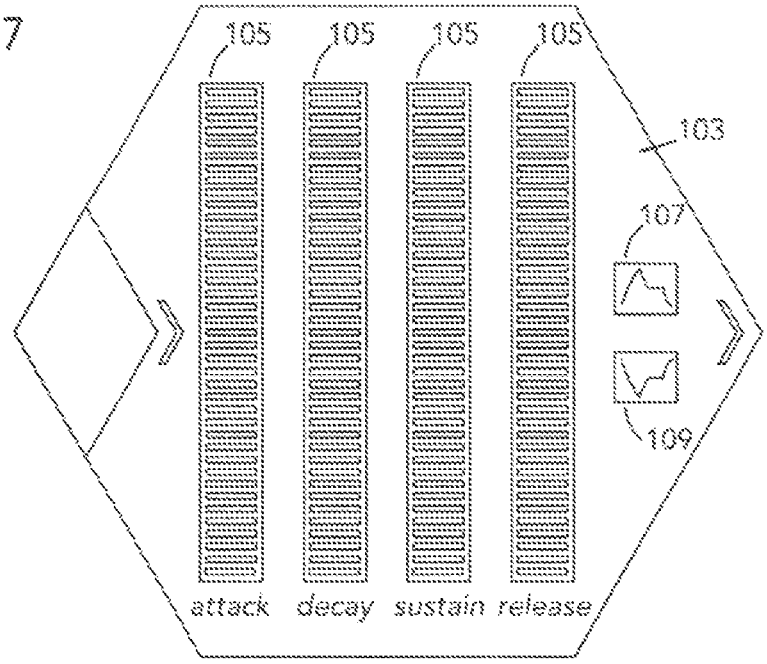
FIG. 7 is a top plan view of a hexagon shaped envelope generator module for the present invention.
Figure 8:
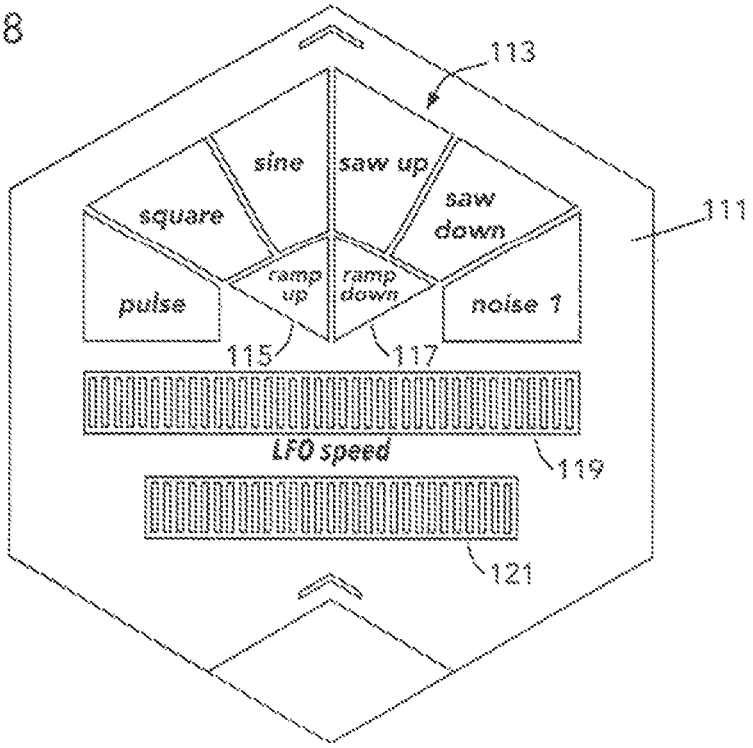
FIG. 8 is a top plan view of a hexagon shaped low frequency oscillator module for the present invention.

An envelope generator (EG) module 103, FIG. 7, emulates a four-stage ADSR envelope generator with slider controls 105 for each stage. It also includes positive 107 and negative 109 polarity controls.

A low frequency oscillator (LFO) module 111 has on its top face, six waveform selectors 113 with ramp up 115 and ramp down 117 selectors. A LFO speed (frequency) slider control 119 is adjacent the selectors 113. A input modulation slider control 121 is adjacent to the frequency control 119.

Figure 9:
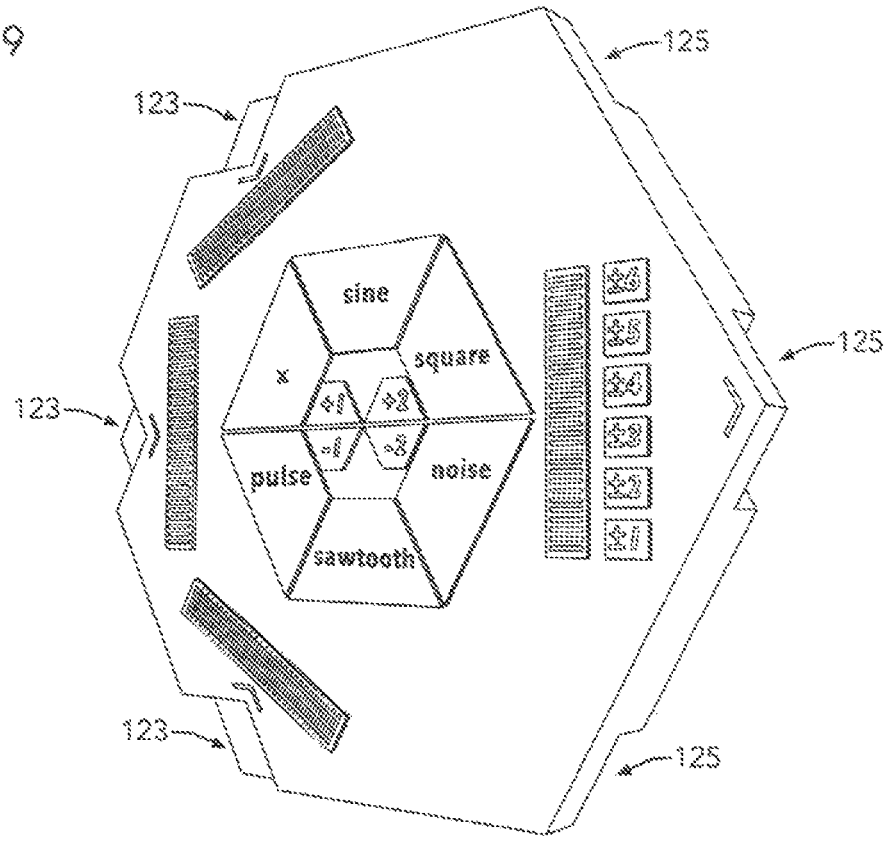
FIG. 9 is a perspective view of the oscillator module of FIG. 5 showing the RFID proximate connection regions.

FIG. 9 shows a perspective view of a module where RFID proximate rhomboid shaped connection locations (points) can be seen. Receiving rhomboid points 123 have a socket cut out in the top face of the module. Projecting-connecting points 125 have a socket cut out in the bottom face of the module.

Figure 10:
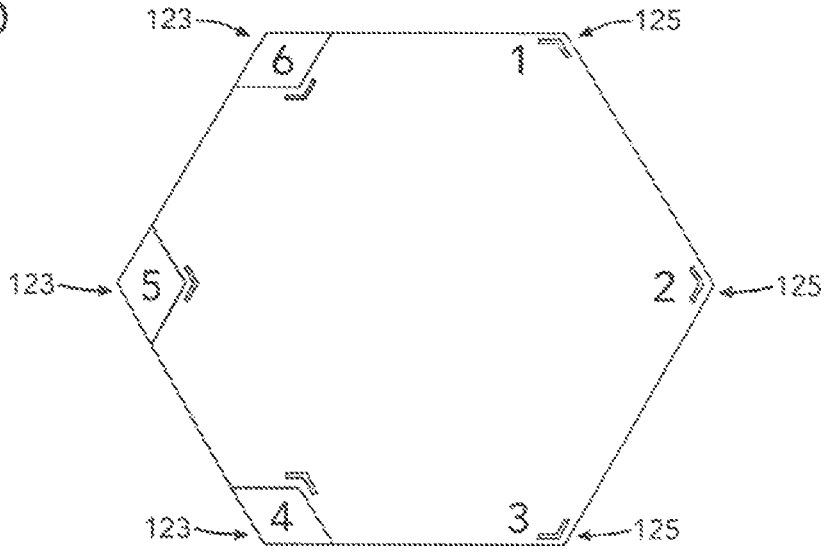
FIG. 10 is a block diagram of the six corners of a hexagon module with the connection corners numbered.
Figure 11:
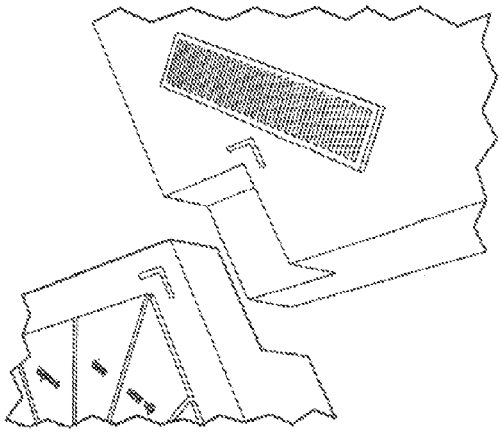
FIG. 11 shows a perspective partial view of two modules about to be connected.
Figure 12:
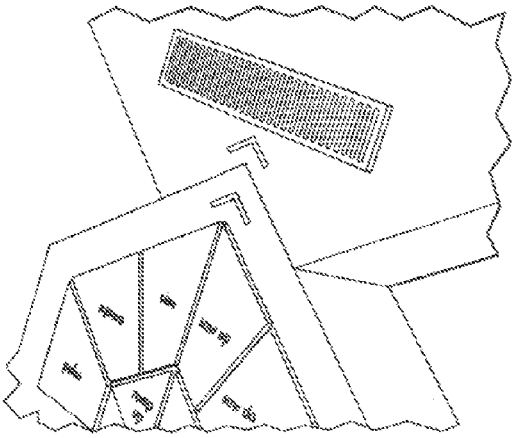
FIG. 12 shows a perspective partial view of the modules of FIG. 11 after connection.

FIG. 10 shows a diagram or the hexagonal shape of each module. Forward (projecting) connection points 125 are numbered 1, 2, and 3. Receiving connection points 123 are numbered 4, 5, and 6. FIG. 11 shows two modules about to be connected at a respective RFID connection point. FIG. 12 shows the two modules after connection.

Figure 13:
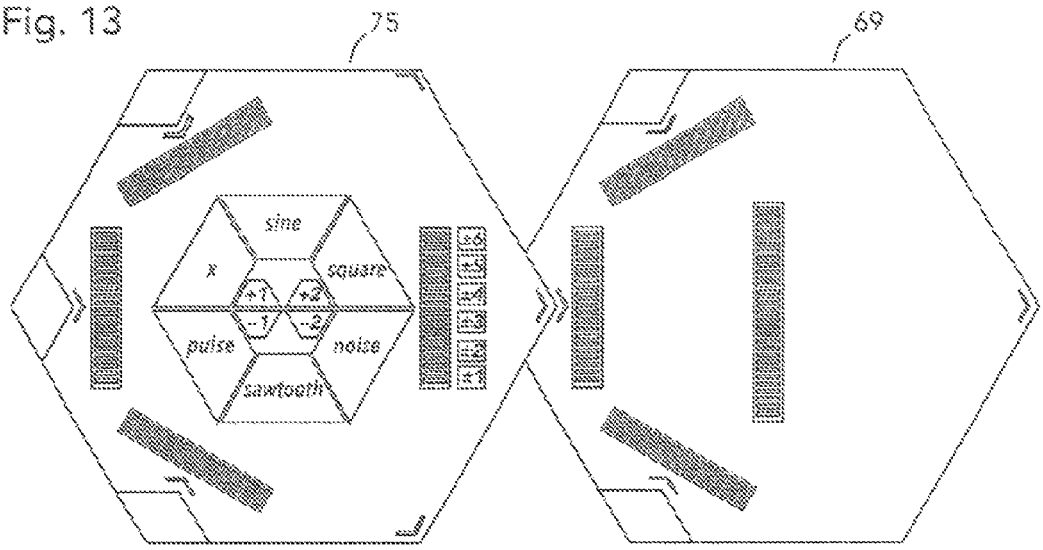
FIG. 13 shows a plan view of the simplest signal chain for the invention with an oscillator connected to the AmpIO.

As a user-musician progresses in proficiently in operating the synthesizer of the present invention, they will be encouraged to assemble more complex synthesizer configurations. FIG. 13 shows the connection of an AmpIO module 69 with an oscillator module 75. This is a minimal configuration of the least number of modules to generate an audio sound.

Figure 14:
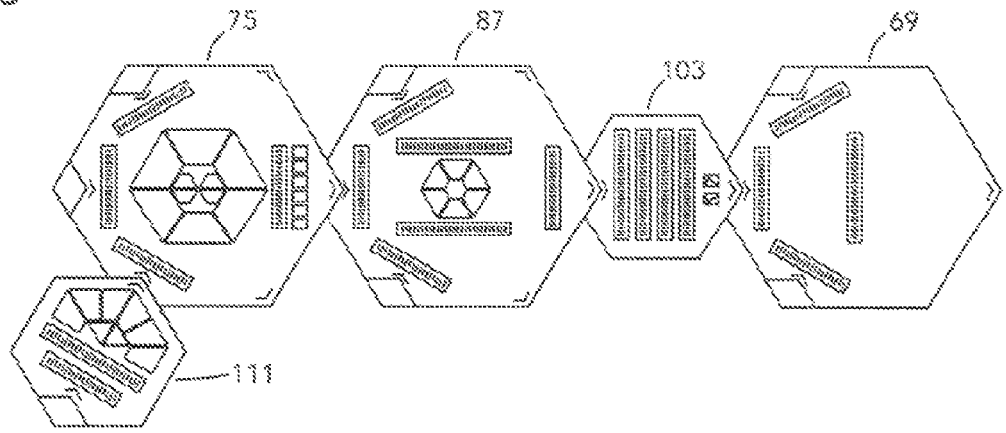
FIG. 14 shows a plan view of interconnected modules for a basic subtractive synthesizer.

FIG. 14 shows a more complicated assembly of an oscillator module 75 connected to an filter module, which in turn is connected to the AmpIO module 69 through a connection of an EG envelope module 103. A LFO module 111 is connected to the oscillator module. The principal waveform generation and modification modules and the amplifier power module are of the larger size hexagonal shape. The more subtle shaping modules are of the smaller size hexagonal shape. The physical arrangement of modules is logical for signal generation and modification, i.e., audio waveform production and shaping for a subtractive audio synthesizer. It is to be remembered, that the modules do not contain the operational circuitry which they each represent. They merely contain a transceiver circuit which transmits the user musician's selections to the CPU, which implements the user musician's selections and actions in software.

Figure 15:
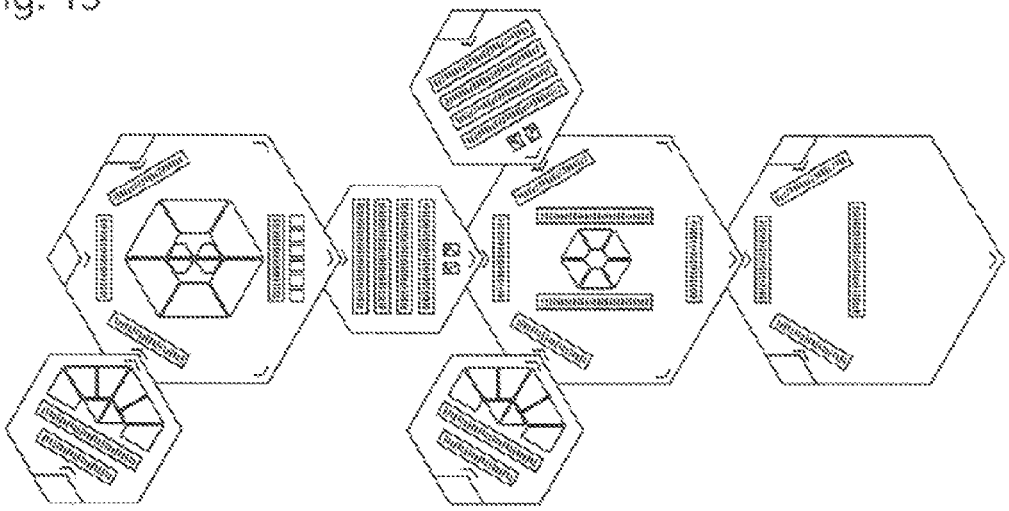
FIG. 15 shows a plan view of interconnected modules for a synthesizer with filter modulation.

FIG. 15 shows an assembled system where the oscillator is being modulated by an LFO and its output is being shaped by an EG before entering the filter. The filter has two modulators, an EG and an LFO. The LFO defaults to constant run operation. The EG defaults to trigger mode. The frequency is calculated initially from LFO modulation and then EG modulation is applied to the value of the frequency. To the user-musician the system of FIG. 15 appears as a real hardware synthesizer. But in reality it is a virtual synthesizer being software implemented in the CPU.

Figure 16:
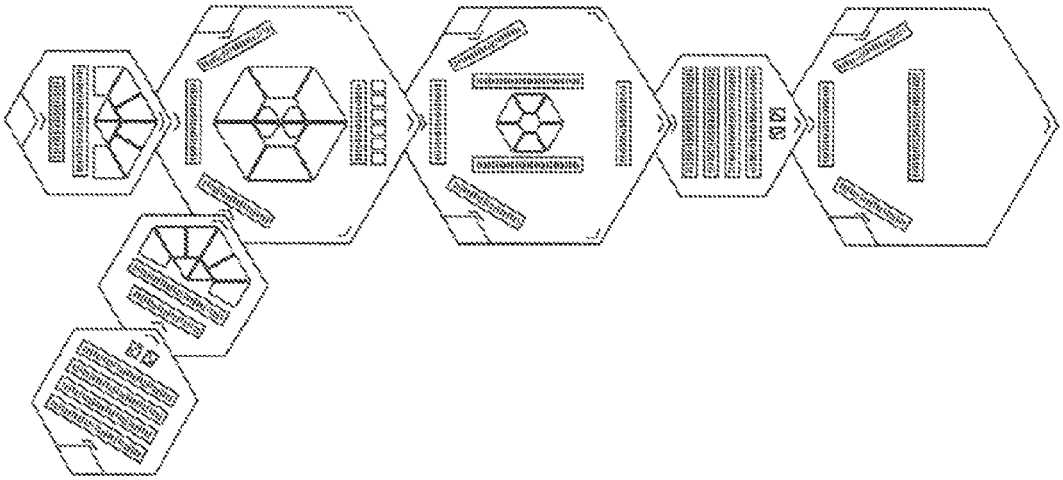

By adjusting the placement and selection of modules, a different kind of sound generation structure can be built (assembled). FIG. 16 shows the synthesizer of the present invention focusing on oscillator modulation. The lower oscillator input permits pulse width modulation by the LFO, where the LFO is modulated by the triggered EG. A second LFO modulates oscillator frequency. The output from the oscillator is driven through the filter and then the entire signal is routed though another EG before reaching the amplifier. The hybrid, hardware-software implementation of the present invention produces this signal processing with a virtual synthesizer.

Figure 17:
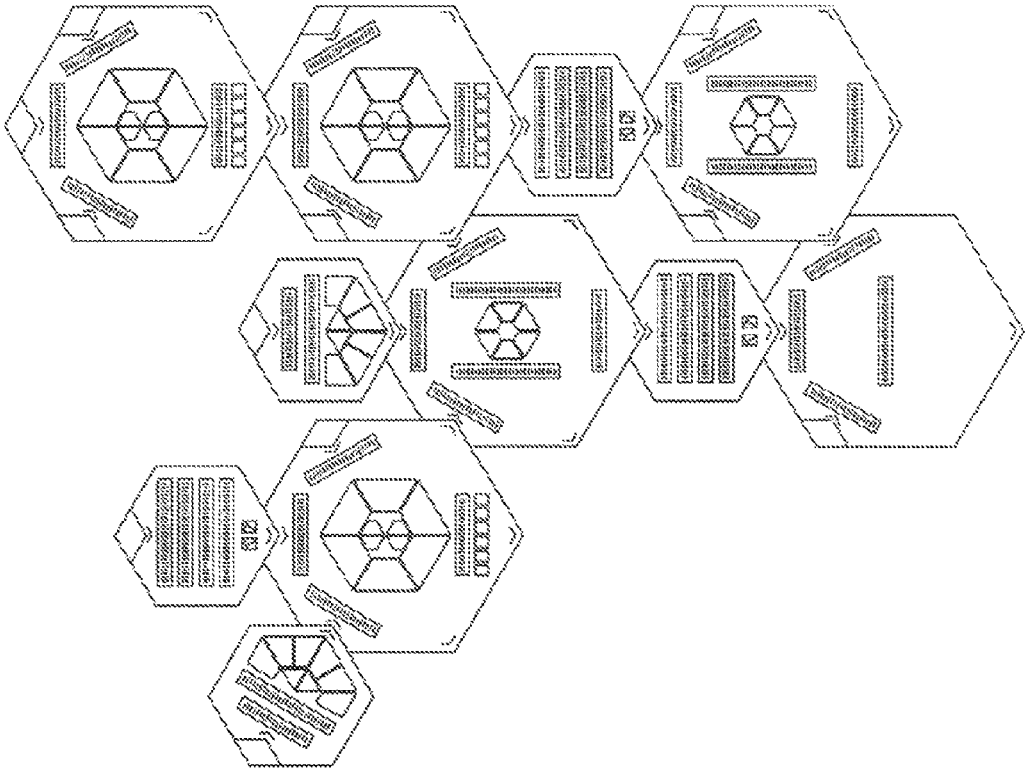
FIG. 17 shows a plan view of interconnected modules for an expanded duplicated module function synthesizer system.

It is only the power capacity of the AmpIO module and the processing limits of the system CPU that limits the size and complexity of the synthesizer module "layout". FIG. 17 shows a very large layout which according to the principals of the present invention can be easily conceived, constructed and understood.

Figure 18:
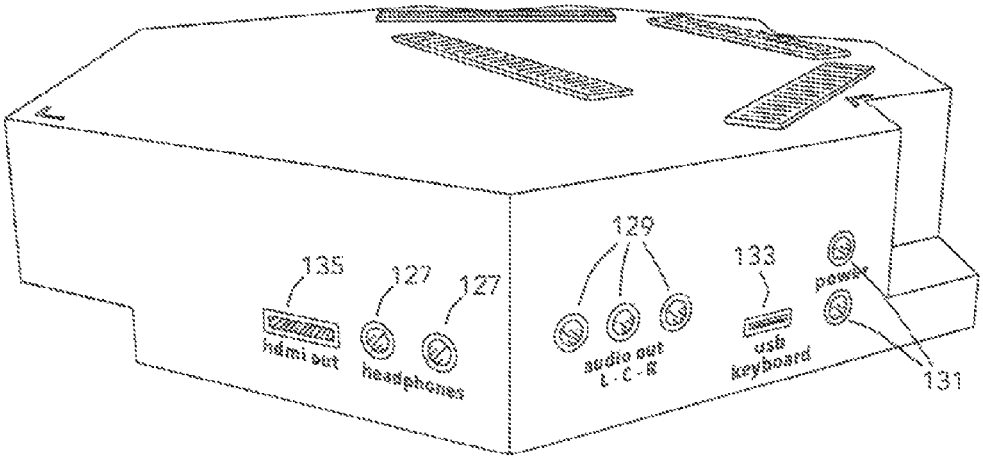
FIG. 18 shows a plan view of interconnected modules for a synthesizer with oscillator modulation.
Figure 19A:
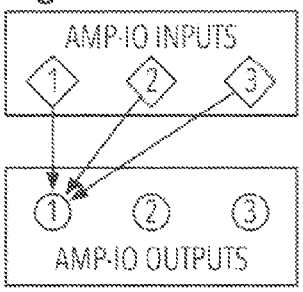
FIGS. 19*a*, 19*b*, and 19*c* show three choices for amplifier input to output connections for the AmpIO circuit.
Figure 19B:
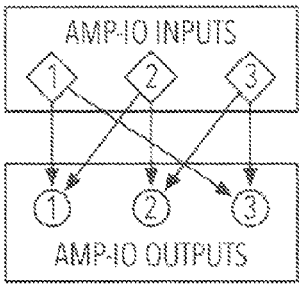
Figure 19C:
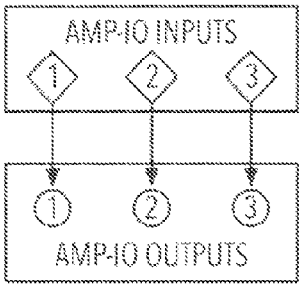

The AmpIO module 69, FIG. 18 can have one-eighth inch receptacles for connecting headphones, and one-quarter inch type receptacles for connecting right, left and center channel output cables. The module has two connectors 131 for power in, a USB connector 133 for a keyboard (and mouse) input, and an HDMI connector 135 for video out. FIGS. 19*a*, 19*b* and 19*c* are graphical presentations for various AmpIO connections. If only one output has a cable, all inputs are routed to that one output, FIG. 19*a*. If any two adjacent outputs have a cable, then each output gets two inputs, FIG. 19*b*. If all three outputs have a cable, then each input is routed to its corresponding output.

Figure 20:
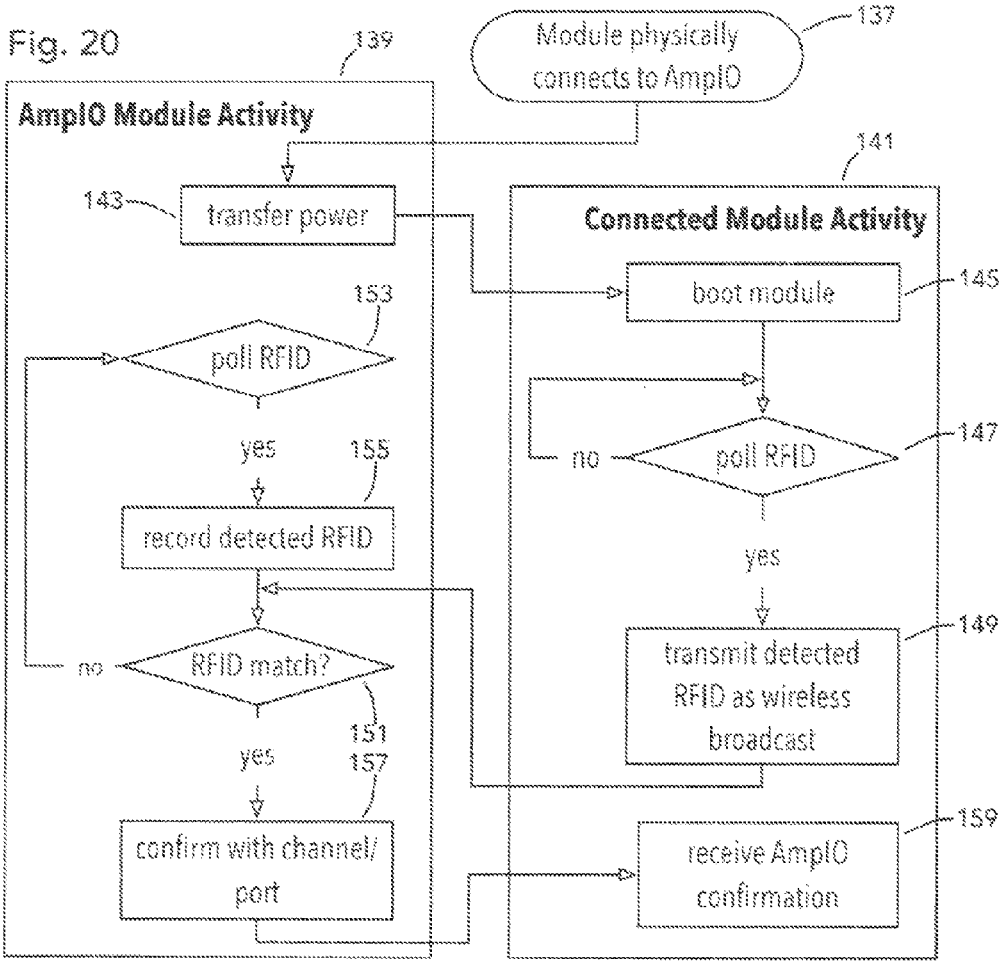
FIG. 20 is a logic block diagram for module connection detection.

FIG. 20 shows a logic flow chart for connection detection logic. When a module is physically connected into the system 137 and therefore is connected to receive power from the AmpIO, the system checks for the authenticity of the connection. This includes AmpIO module activity 139 and connected module activity 141. Power is transferred 143 to boot the module 145. The RFID is polled until a detection occurs, wherein the fact that there is detection is sent 149 to the AmpIO module. Then there is a determination if there is an RFID match 151. If not, the RFID is polled again 153 and the detected RFID is recorded 155 and the match again is sought 151. If a match is determined it is confirmed and a channel is opened to receive AmpIO confirmation 159.

Figure 21:
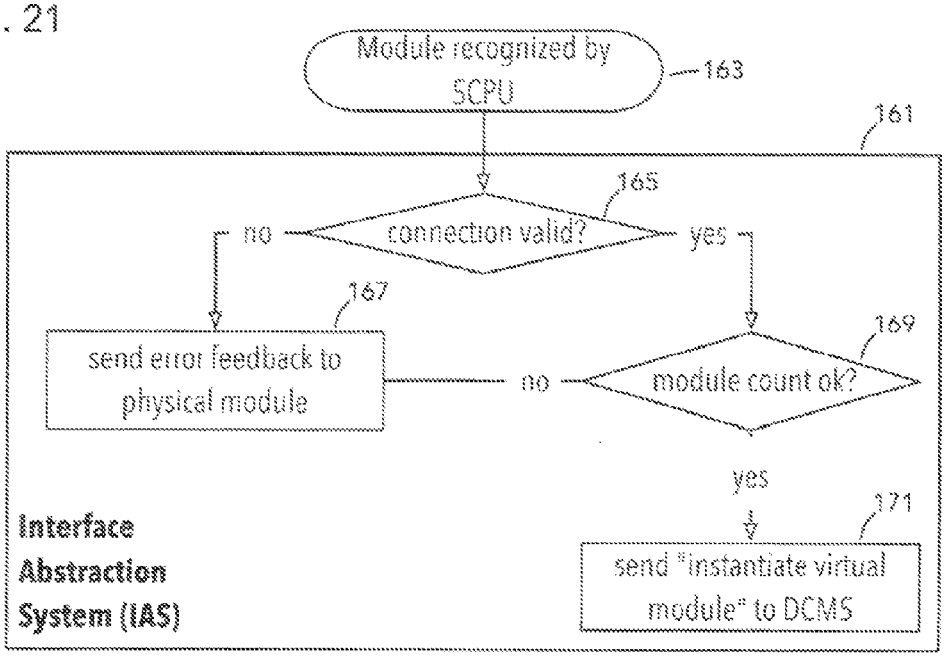
FIG. 21 is a logic block diagram for module connect approval.
Figure 22:
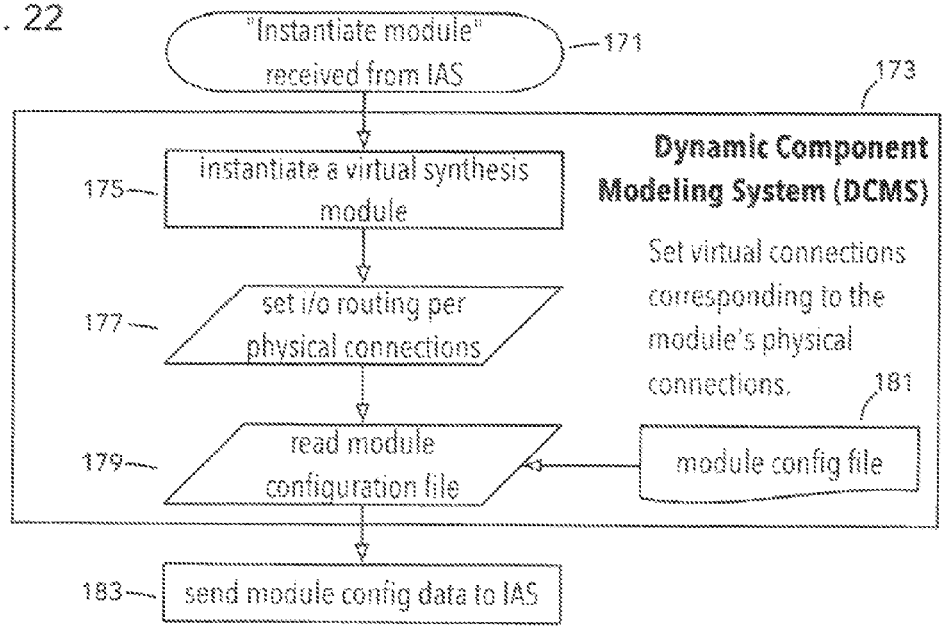
FIG. 22 is a logic block diagram for dynamic component modeling.

An interface abstraction system 161 permits the use of a software interface or a hardware interface. When a module-to-module connection (in software or hardware) is recognized 163 by the interface abstraction system, that connection is evaluated by the CPU in the AmpIO module, FIG. 21. A determination 165 is made of whether the connection is valid. If no valid connection an error signal is sent 167 to the module, if the connection is valid 165, a module count is made 169 against the capacity of the CPU. If the count is not within limits, an error signal is sent 167 to the physical module. If the connection is valid and the count is within limits an "instantiate virtual module" signal is sent 171 to the DCMS (dynamic component modeling system).

The DCMS 173 operates on the signal sent 171 from the interface abstraction system (IAS). If first instantiates 175 a virtual synthesis module, it then sets 177 I/O (input-output) routing and connections, and reads 179 the module configuration file from the module configuration database 181 (if present), and sends 183 the module configuration data to the IAS.

Figure 23:
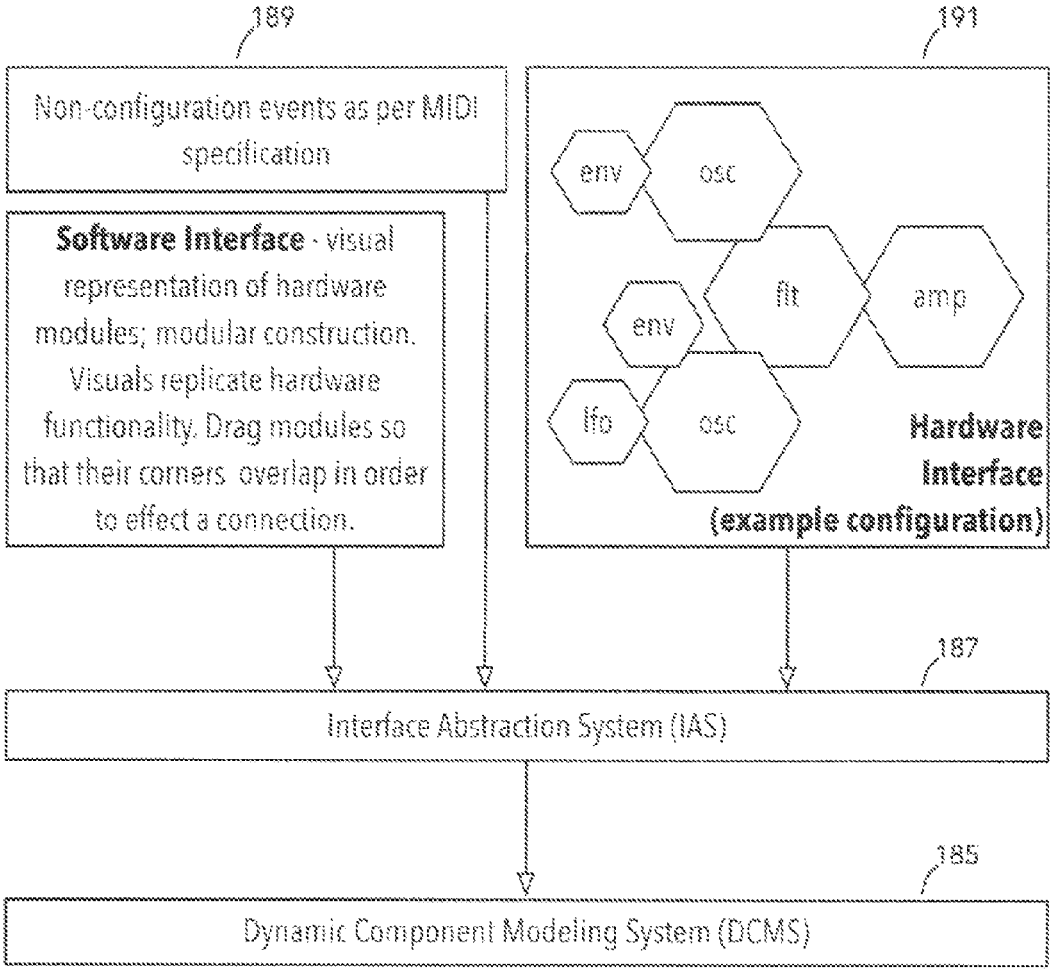
FIG. 23 is a functional block diagram of the major operational sections of the present invention, a modular music synthesizer implemented in a hybrid system of hardware and software.

FIG. 23 is a block diagram representation of the hardware/software implemented, virtual synthesizer of the present invention, which presents itself as a modularly connected and modularly expandable hardware system but is really a softsynth driven system. The dynamic component modeling system 185 is implemented by softsynth software operating the CPU. The DCMS receives data and instructions from the interface abstraction system. The IAS acts as the softsynth input interface module for signals coming from possible MIDI (musical instrument digital interface) input from an optional keyboard. The IAS 187 also receives inputs from the modular assembly of hexagonal modules 191. This modular assembly 191 provides the human interface with the user-musician.

Figure 24:
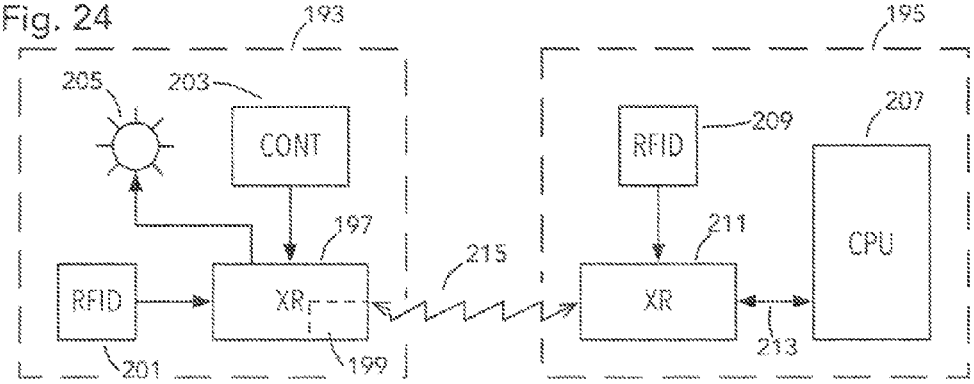
FIG. 24 is a functional block diagram of the communications between a module and the AmpIO module containing the CPU.

The communications between any of the signal generating or signal shaping modules (oscillator, filter, LFO, EG or HFO) 193 and the CPU containing module 195 is shown in FIG. 24. Each module 193 has a transceiver circuit 197 with software diagnostics 199. This transceiver 197 is connected to receive signals from the RFID detectors 201 and the user manually operated controls 203. It is also connected to activate the signals 205 when the CPU determines an unacceptable condition exists. The CPU 207 resident module 195 also has a transceiver 209, which receives inputs from an on-board RFID circuit 211, is in two-way communications 213 with the CPU 207. The module 193, 195 respective transceivers 197, 209 are in two-way wireless communication 215

The synthesizer of the present invention is simple to use and manipulate, while providing complex capabilities.

Many changes can be made in the above-described invention without departing from the intent and scope thereof. It is therefore intended that the above description be read in the illustrative sense and not in the limiting sense. Substitutions and changes can be made while still being within the scope and intent of the invention and of the appended claims.

The invention claimed is:

1. A modular music synthesizer, comprising:

an amplifier module providing an audio output;

a plurality of circuit modules each presenting the appearance of a specific hardware signal generation or signal modification circuit having user controls simulating the control of the respective apparent hardware circuit module, the plurality of circuit modules being connected in a physical arrangement with each other and the amplifier module; and wherein the amplifier module includes a CPU operating on softsynth software, for emulating the operation of a synthesizer to produce audio output as a function of the physical arrangement of the modules and the status of the controls on each module.

2. The synthesizer of claim 1, wherein said plurality of circuit modules are chosen to appear from a group of oscillator circuit, filter circuit, envelope generator (EG) circuit, low frequency oscillator (LFO) circuit, and high frequency oscillator (HFO) circuit, and wherein said modules are each hexagonal shaped.

3. The synthesizer of claim 1, wherein said amplifier module and said plurality of circuit modules are each hexagonal shaped, wherein said amplifier module and said plurality of circuit modules constituting said physical arrangement are connected with each other at connections formed between modules, wherein the connections are made between modules at connection points provided at their respective corners.

4. The synthesizer of claim 3, wherein each apparent hardware circuit module contains a smart transceiver circuit, each smart transceiver circuit being in two-way wireless communication with the CPU.

5. The synthesizer of claim 4, wherein each module has a proximity sensor at each of its respective connection points, the proximity sensors being paired in a handshake status when two modules are connected to provide connection status data to the CPU through the smart transceiver circuits of each connected module; and wherein the status data includes information identifying the module's apparent hardware circuitry.

6. The synthesizer of claim 5, wherein the CPU also includes a database of configuration data for each apparent hardware circuit module, this configuration data being used with each module's apparent hardware circuitry identification and connected module physical arrangement data by the CPU to provide the audio output.

7. The synthesizer of claim 6, wherein the plurality of apparent hardware circuits are chosen from oscillator circuits, filter circuits, LFO circuits, HFO circuits, and EG circuits.

8. A modular music synthesizer, comprising:

an amplifier module providing an audio output;

a first module connected to said amplifier module, said first module being selected from a group of oscillator, filter, LFO, EG, and HFO modules; and wherein said amplifier module and said first module connection is sensed by proximity sensors on each module, said first oscillator module being powered from said amplifier module through said connection.

9. The synthesizer of claim 8, wherein said amplifier module is provided with a power source, and wherein said amplifier module includes a CPU, wherein said proximity sensors are RFID sensors on said amplifier module and said first module, said first module sending a signal indicating the status of the connection to said amplifier module CPU.

10. The synthesizer of claim 9, wherein said CPU interrogates the RFID sensed manual connection between modules and sends a signal to said first module if a valid connection is not sensed.

11. The synthesizer of claim 10, also including one or more additional modules chosen from the group of oscillator, filter, LFO, EG, and HFO modules, each of said first module and said additional modules being capable of being connected to said CPU containing amplifier module directly or indirectly through a chain connection of modules, wherein each connection is RFID sensed and the status transmitted to said CPU.

12. The synthesizer of claim 11, wherein each connection for each module is RFID sensed, wherein said CPU interrogates each RFID sensed connection and signals invalid connection back to the respective additional module, and wherein said CPU monitors module count of connected modules to determine if one of the required power draw on the amplifier module and the required processing capability for the connected modules exceeds a respective one of the power and the processing capacity of said amplifier module.

13. The synthesizer of claim 12, wherein each connected module is hexagonal shaped and is connected to one or more other modules at a respective connection point, and wherein each connection point is positioned at a respective corner of each module.

14. The synthesizer of claim 13, wherein said CPU operates under the direction of softsynth software to emulate synthesizer functions to provide an audio output consistent with a module configuration file for each connected module, these module configuration files being used by the software to emulate a hardware synthesizer operation having hardware modules simulated by the connected hexagonal modules.

15. The synthesizer of claim 14, wherein the configuration of the softsynth is determined by the physical arrangement of the hardware hexagonal modules that represent the functionality of hardware modules in software, the hardware hexagonal modules each having user operated controls and providing inputs to the CPU which simulates in software one or more parameters corresponding to the inputs, wherein the inputs correspond to the controls being operated by a user.

16. The synthesizer of claim 8, further comprising one or more additional modules chosen from the group of oscillator, filter, LFO, EG, and HFO modules, each of said first module and said additional modules being capable of being connected to said CPU containing amplifier module directly or indirectly through a chain connection of modules, wherein each connection is RFID sensed and the status transmitted to said CPU, and wherein each of said amplifier module, said first module and said additional modules is capable of being directly connected to any other of said amplifier module, said first module and said additional modules.

17. A modular music synthesizer, comprising:

an assembly of interconnected modules each module representing a signal generation or signal modification function, wherein each module has a hexagonal shape, the connections between modules being at the respective corners of each module;

a RFID proximity sensor at each point of each module providing a handshake signals when modules are connected, the handshake signal indicating the validity of the connection and the identification of the modules connected;

wherein one of the modules is an amplifier module having a CPU providing an audio output;

wherein the other modules are selected to appear as any one from the group of oscillator circuitry, HFO circuitry, LFO circuitry, filter circuitry and EG circuitry;

wherein the handshake validity and identification signals are sent to the CPU.

18. The synthesizer of claim 17, wherein each of the other modules having apparent oscillator, or HFO, or LFO, or filter, or EG circuitry include user controls consistent with the apparent circuit within the module, wherein the status of each module's controls is transmitted to the CPU.

19. The synthesizer of claim 18, wherein the other modules having apparent oscillator, or HFO, or LFO, or filter, or EG circuitry may be selectively added to or removed from the assembly piecewise.

20. The synthesizer of claim 19, wherein the CPU also contains a database for each module's configuration information, wherein the CPU operation is directed by softsynth software, and uses the assembly connection information, each module configuration information, and information on the statues of each modules controls to emulate a hardware synthesizer to produce the audio output.

* * * * *